US012024319B2

(12) United States Patent
Sas Freixenet et al.

(10) Patent No.: US 12,024,319 B2
(45) Date of Patent: Jul. 2, 2024

(54) MACHINE FOR FILLING BAGS WITH A GRANULAR PRODUCT AND CORRESPONDING FILLING METHOD

(71) Applicant: TÉCNICAS MECÁNICAS ILERDENSES, S.L., Lleida (ES)

(72) Inventors: Josep Sas Freixenet, Lleida (ES); Juan José González Toledano, Lleida (ES)

(73) Assignee: TÉCNICAS MECÁNICAS ILERDENSES, S.L., Lleida (ES)

( * ) Notice: Subject to any disclaimer, the term of this patent is extended or adjusted under 35 U.S.C. 154(b) by 24 days.

(21) Appl. No.: 18/014,424

(22) PCT Filed: Jul. 17, 2020

(86) PCT No.: PCT/ES2020/070465
§ 371 (c)(1),
(2) Date: Jan. 4, 2023

(87) PCT Pub. No.: WO2022/013461
PCT Pub. Date: Jan. 20, 2022

(65) Prior Publication Data

US 2023/0257140 A1 Aug. 17, 2023

(51) Int. Cl.
*B65B 1/06* (2006.01)
*B65B 1/22* (2006.01)
(Continued)

(52) U.S. Cl.
CPC ..... *B65B 1/06* (2013.01); *B65B 1/22* (2013.01); *B65B 43/54* (2013.01); *B65B 51/146* (2013.01); *B65B 51/225* (2013.01); *B65B 51/32* (2013.01)

(58) Field of Classification Search
None
See application file for complete search history.

(56) References Cited

U.S. PATENT DOCUMENTS

2002/0121074 A1* 9/2002 Townsend ..... B65B 43/465 53/459

FOREIGN PATENT DOCUMENTS

DE 10232136 A1 * 1/2004 ..... B65B 1/28
DE 10232136 A1 1/2004
(Continued)

OTHER PUBLICATIONS

International Search Report from corresponding International Application No. PCT/ES2020/070465 mailed on Mar. 19, 2021.

*Primary Examiner* — Tanzim Imam
(74) *Attorney, Agent, or Firm* — Tucker Ellis LLP

(57) ABSTRACT

A machine for filling bags with a granular product includes a filling station. The machine further includes a supporting device for supporting bags below the filling station. The supporting device includes an assembled supporting surface pivoting on a pivot shaft, and actuating means. The actuating means are a motor the angular position of which is controlled by control means. The supporting surface has a first end, arranged upstream of said filling station in the forward movement direction of the bags, and a second end, arranged downstream of said filling station in the forward movement direction of the bags. The supporting surface can pivot in an alternating manner around said pivot shaft for moving the base of the bag which is located in the filling station in operation during filling. A method for filling said bag can also be employed.

16 Claims, 6 Drawing Sheets

(51) Int. Cl.

| | |
|---|---|
| ***B65B 43/54*** | (2006.01) |
| ***B65B 51/14*** | (2006.01) |
| ***B65B 51/22*** | (2006.01) |
| ***B65B 51/32*** | (2006.01) |

(56) References Cited

FOREIGN PATENT DOCUMENTS

| | | | | | |
|---|---|---|---|---|---|
| ES | 2388510 | A1 | * | 10/2012 | ..... B65B 43/465 |
| ES | 2388510 | A1 | | 10/2012 | |
| FR | 2614270 | A1 | | 10/1988 | |
| JP | 2009091023 | A | | 4/2009 | |
| WO | 2014191152 | A1 | | 12/2014 | |

* cited by examiner

MACHINE FOR FILLING BAGS WITH A GRANULAR PRODUCT AND CORRESPONDING FILLING METHOD

RELATED APPLICATION DATA

This application is a national phase application of International Application No. PCT/ES2020/070465 filed Jul. 17, 2020. The entirety of the aforementioned application is incorporated herein by reference.

FIELD OF THE INVENTION

The invention relates to a machine for filling bags with a granular product comprising a filling station, actuating means, and a supporting device for supporting bags which forms a unit, arranged below said filling station for supporting the base of the bag located in said filling station to receive said granular product during operation, and said supporting device comprising a supporting surface, a pivot shaft on which said supporting surface is assembled, and a first end and a second end, said supporting surface, said pivot shaft and said actuating means being functionally associated with one another such that said supporting surface can pivot in an alternating manner around said pivot shaft through said actuating means.

Furthermore, the invention also relates to a method for filling bags with a granular product comprising the following steps: arranging a bag on a supporting surface of a supporting device, said bag being arranged below a filling station for filling bags to receive said granular product, filling said bag with said granular product.

STATE OF THE ART

The industry of filling bags with granular products is constantly seeking to increase the bag filling speed to reduce production costs.

In the invention, a product the grain size of which is greater than 50 micra is understood as a granular product. Moreover, in the invention, a machine the hourly production of which is greater than 1800 bags/hour is understood as a high-production or high-speed machine.

One of the important limitations when the bag filling speed is increased resides in the accumulation of air inside the bag during filling. This represents an important problem in the bag filling quality, because if air accumulates inside the bag a larger sized bag that is not completely full must be used. Furthermore, once it is full, the bag readily deforms and adopts irregular shapes, making it difficult to arrange them on pallets.

To avoid this problem, the use of a machine having a fixed filling station and a movable supporting surface arranged below the filling station, on which the base of the bag during filling is supported is known. This supporting surface can move up and down in the vertical direction. While filling the bag is shaken as a result of the bottom moving up and down. This solution consumes a significant amount of energy. Moreover, the upper part of the bag readily deforms and, therefore, the bag is not optimally filled from a geometric viewpoint. This again makes it difficult to arrange them on pallets.

Document ES 2388510 A1 discloses another solution for preventing the accumulation of air while filling the bag. This document envisages that in the filling station, the conveyor belt on which the bag is supported during filling is assembled so as to pivot in an alternating manner around a rotation shaft. Once the filling process has ended, i.e., when the bag is full, the conveyor belt hits the base of the bag to compact the granulated product and make the shape of the bag uniform. In this case, the final shape of the bag is more regular and arranging full bags on pallets is made easier. However, this method does not allow filling bags at high production speeds.

SUMMARY OF THE INVENTION

It is an object of the invention to provide a machine for filling bags with a granular product of the type indicated above, which allows filling bags at high filling speeds. Nevertheless, and despite the high speed, the machine must have a lower consumption of energy and enable the bags to be readily arranged on pallets once they are full and closed. This purpose is achieved by a machine for filling bags with a granular product of the type indicated at the beginning, characterized in that said actuating means comprise a motor and control means, said control means controlling the angular position of said motor to allow said supporting surface to pivot in an alternating manner and with a variable amplitude between any positions from among: an upper position of said first end and a lower position of said second end, and a lower position of said first end and an upper position of said second end, for moving the base of the bag which is located in said filling station in operation during filling. In the state of the art, the pivoting amplitude is constant, which leads to the supporting surface traveling along part of its path in a completely inefficient manner. In contrast, in the machine according to the invention, the pivoting amplitude adapts to the method for filling said bag. In other words, when following only the optimal path, the frequency of hitting the supporting surface in which the bags are supported can be considerably increased because the pivoting path can be better adapted to the filling method. When the supporting surface pivots quickly, it hits the base of the bags supported on it, such that the air is removed from the bags much quicker. Therefore, the granular material contained in the bags is compacted much quicker and the bags can be filled more quickly, thereby reducing the production cost.

The invention further includes a number of preferred features that are object of the dependent claims and the utility of which will be highlighted hereinafter in the detailed description of an embodiment of the invention.

In a preferred embodiment, said motor is a servomotor, which makes it easier to position said supporting surface with higher precision.

Preferably, said actuating means further comprise a crankshaft mechanism which is functionally connected to said supporting device and to said motor for transmitting the movement of said motor to said supporting device. This allows performing the pivoting of the supporting surface in a simple and robust manner.

Preferably, said supporting device has a projection transverse to the forward movement direction of the bags which projects from said first end and is spaced apart from and upstream of said filling station in the forward movement direction of said bags, such that in operation, with said bag being ready to be filled, before beginning to fill said bag, said projection holds the base of said bag spaced apart from said filling station. As a result of this element, when the bag is placed at the entrance of the filling station and before beginning to fill it, its base is supported or held in this projection. This causes the bag to form an angle with respect to the vertical direction. The still empty bag is therefore not in a substantially vertical position slightly supported on the supporting surface. This prevents the effect of preliminary creases from being formed at the bottom of the bag in some cases. Once filling begins, these creases make it difficult to obtain a bag with a regular shape or geometry. As a consequence of this irregular geometry impairs the arrangement of the bag on the pallet.

In an embodiment which seeks to improve the orientation of the bags during conveyance from station to station, said supporting device is a conveyor belt. The bags are transferred from station to station secured by the opening thereof, but as a result of the lower conveyor belt they are prevented from being able to flip over due to a rather imprecise base support position.

Preferably, said machine further comprises a bag welding station and a bag cooling station arranged above said supporting device and downstream of said filling station in the forward movement direction of the bags, said supporting surface extending between said filling, welding, and cooling stations such that each of said bags is supported, said supporting surface forming a unit suitable for pivoting in an alternating manner around said pivot shaft through said actuating means. In this configuration, the full bags of the welding and cooling stations balance out the movement of the supporting surface hitting the base of the bag that is being filled. As a result, the electrical consumption of the assembly is reduced. Furthermore, this allows for a quicker pivoting, which makes it easier to increase the filling speed without the bottom of the bag becoming creased. Moreover, the pivoting takes place during the bag filling operation which is located in the filling station. The cycle speed is thereby reduced without losing the capacity to achieve a bag shape that can be readily arranged on pallets.

Preferably, said first end is arranged upstream of said filling station in the forward movement direction of the bags and said second end is arranged downstream of said filling station in the forward movement direction of the bags, which allows more effectively balancing out the supporting surface.

In another embodiment, said welding station and said cooling station are arranged at the same distance from said pivot shaft. The balancing out of the supporting device when the bag pending filling is empty is thereby optimized.

In another embodiment which has the objective of improving and accelerating the sealing of the bag, gas actuating means are provided in the cooling station arranged for insufflating cooling gas into the area corresponding to the welding spots of the bag during operation.

The invention also relates to a method for filling bags with a granular product of the type indicated above which is characterized in that it further comprises the following steps: causing said supporting surface to pivot in an alternating manner around a pivot shaft during said filling step through actuating means comprising a motor and control means, and controlling the angular position of said motor through said control means for said supporting surface to pivot in an alternating manner and with a variable amplitude between any positions from among an upper position of said first end and a lower position of said second end, and a lower position of said first end and an upper position of said second end, for moving the base of said bag. This method allows considerably increasing the frequency of hitting the supporting surface on which the bags are supported, because the pivoting path can be better adapted to the method for filling said bag. Likewise, as previously mentioned, when the supporting surface pivots quickly, it hits the base of the bags supported on it, such that the air is removed from the bags much quicker, which leads to the granular material contained in the bags being compacted much quicker. This allows filling the bags more quickly, thereby reducing the production cost.

In a preferred embodiment, said supporting surface pivots in an alternating manner and with a variable amplitude between any positions from among an upper position in which said first end and said second end are at the same height and a lower position of said first end and an upper position of said second end, which allows hitting the bag that is being filled.

Preferably, said method further comprises a welding step and a cooling step for welding and cooling corresponding bags, during which steps each of the bags that is in each of said steps is supported at its base on said supporting surface of said supporting device for supporting bags which forms a unit, said supporting surface pivoting in an alternating manner around said pivot shaft through said actuating means. These steps are carried out simultaneously together with the filling step, which increases production. Furthermore, the bags located supported in said welding and cooling stations help to balance out the supporting surface such that the pivoting of the supporting surface can be performed more quickly, thereby improving the filling time.

Preferably, said step of controlling the angular position of said motor determines a pivoting amplitude between said upper position of said first end and a lower position of said second end and said lower position of said first end and an upper position of said second end, such that said amplitude decreases as said bag is being filled. Preferably, said amplitude decreases in a constant manner. Again, this allows filling the bags more quickly.

Preferably, said step of controlling the angular position of said motor establishes a maximum pivot position in which said first end and said second end are aligned with said pivot shaft, such that during said pivoting, said supporting surface pivots in an alternating manner between any position from among said maximum pivot position and said lower position of said first end and an upper position of said second end. The pivoting frequency can thereby be increased.

Preferably, said method further comprises a holding step for holding the base of said bag, arranged upstream of said filling step in the forward movement direction of the bags, in which, before beginning to fill said bag, the base of said bag is held spaced apart from said filling step. The formation of creases in the bottom of the bag is thereby prevented.

Likewise, the invention also includes other features of detail illustrated in the detailed description of an embodiment of the invention and in the accompanying figures.

BRIEF DESCRIPTION OF THE DRAWINGS

Further advantages and features of the invention will become apparent from the following description, in which, without any limiting character, preferred embodiments of the invention are disclosed, with reference to the accompanying drawings in which.

DETAILED DESCRIPTION OF EMBODIMENTS OF THE INVENTION

Figure 1:
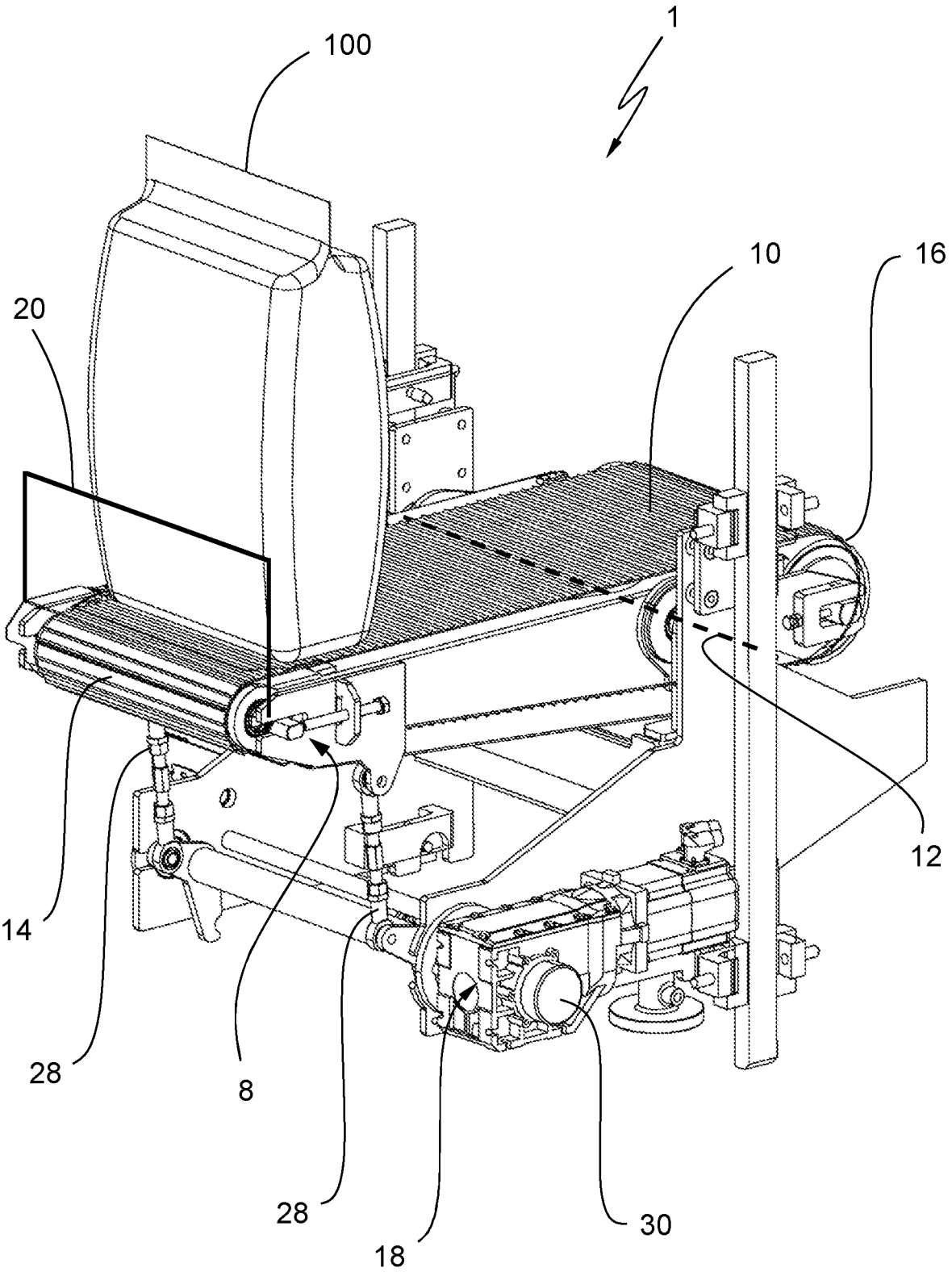
FIG. 1 shows a schematic perspective view of the machine for filling bags with a granular product according to the invention in which the supporting surface of the bags is located in an upper position in which said first end and said second end are at the same height.
Figure 2:
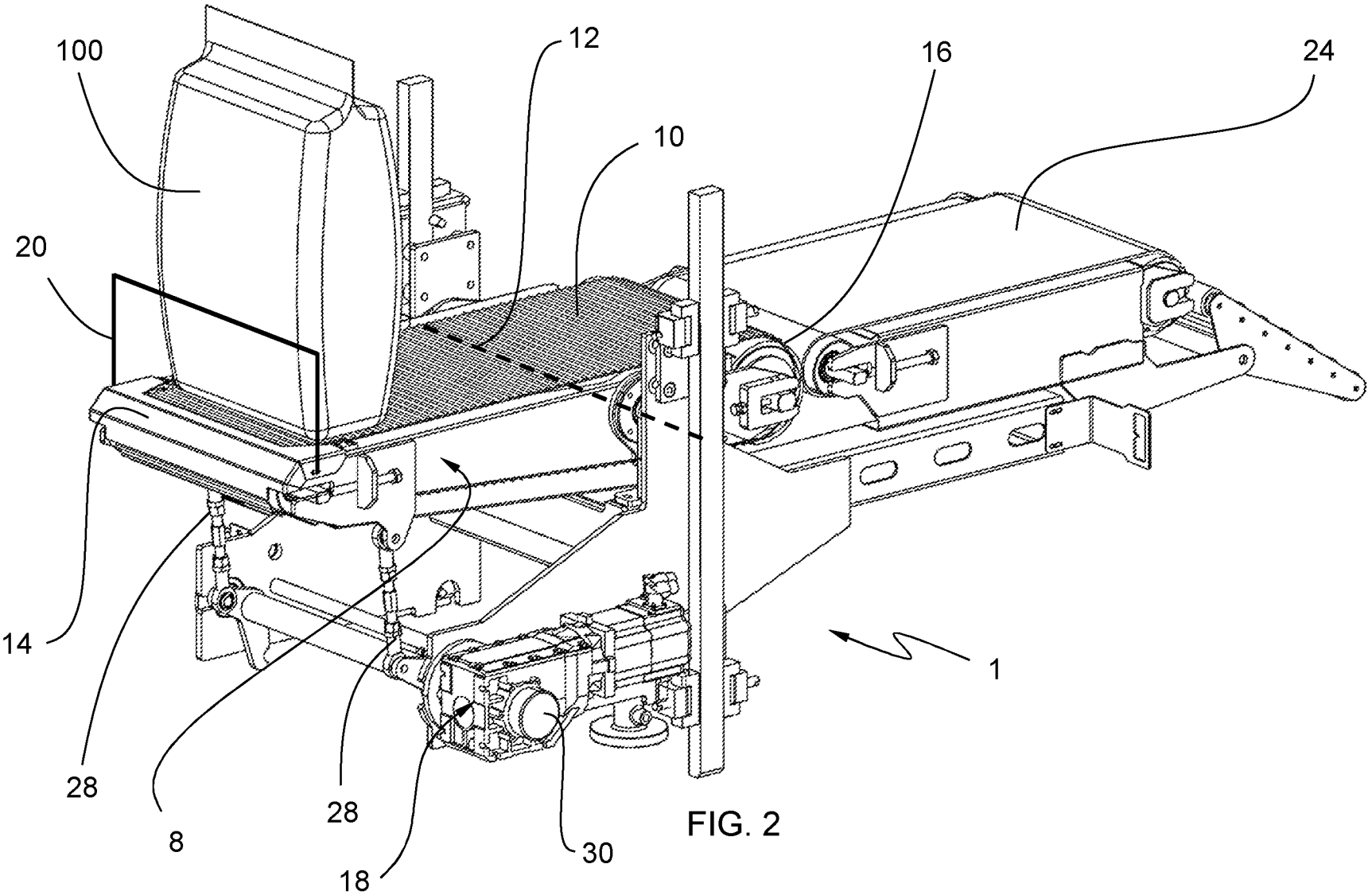
FIG. 2 shows a schematic perspective view of the machine according to the invention in which a second bag discharge conveyor belt is arranged downstream of the supporting surface.
Figure 3:
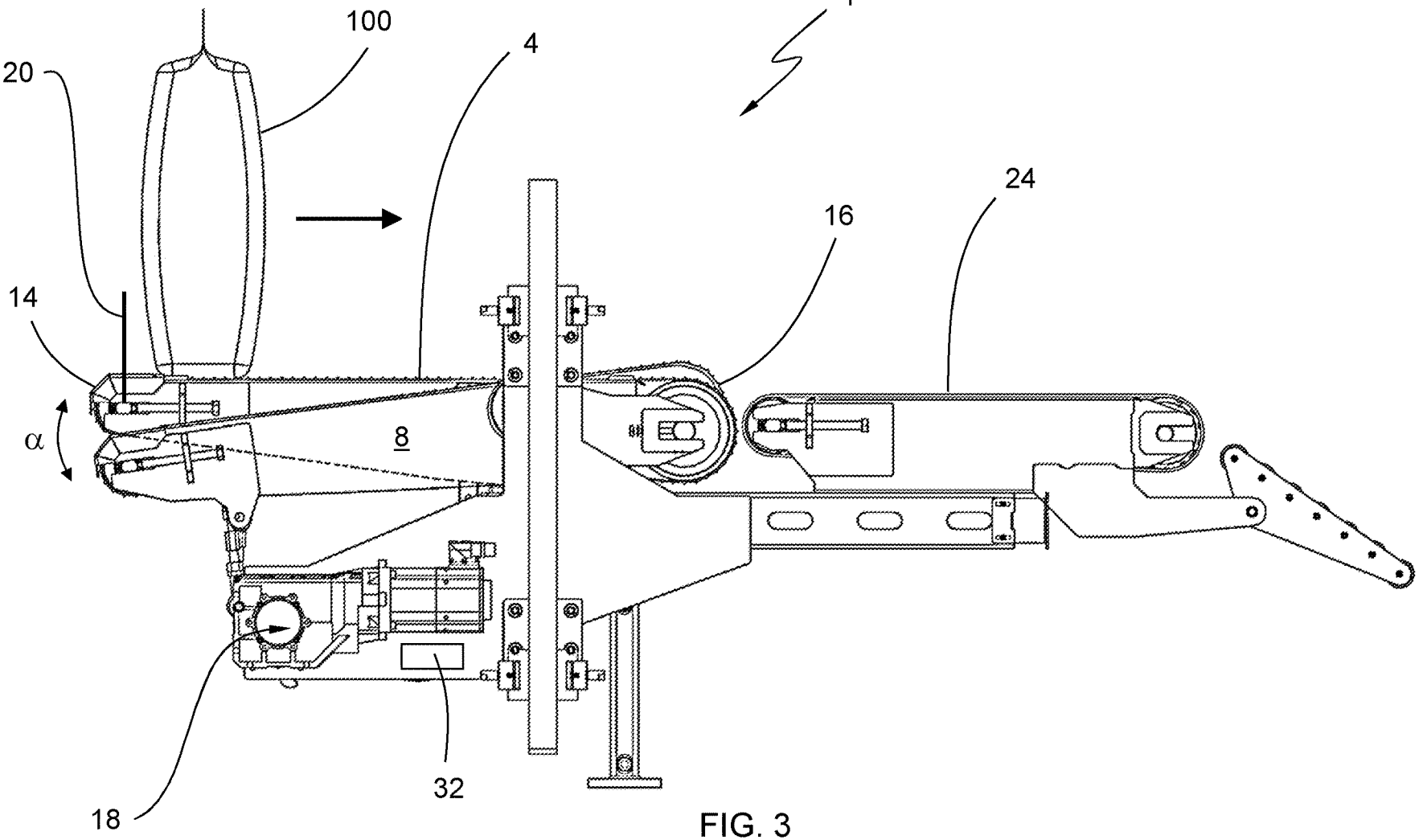
FIG. 3 shows a schematic side profile view of FIG. 2 in which a pivoting amplitude is depicted.

An embodiment of a machine 1 for filling bags 100 with a granular product according to the invention can be seen in the figures.

In the upper part, the machine 1 comprises a filling station 2 and a welding station 4 and cooling station 6 arranged downstream of the filling station 2 in the forward movement direction of the bags 100. These stations are schematically indicated only in FIG. 4. In a more particularly preferred manner, there is arranged in the welding station 4 a welding device 26 consisting of a welding device by heat sealing or by ultrasonic sealing. Also in a preferred manner, gas actuating means 22 can be provided in the cooling station for insufflating cooling gas into the area corresponding to the welding spots of the bag 100 during operation.

Some known non-limiting examples of machines having these filling, welding, and cooling stations are machines for filling preformed bags or machines in which the bags are manufactured in the actual machine from laminar material and known in the art by the acronym FFS, meaning Form, Fill, and Seal. The features of these stations are known to the person skilled in the art, so it is not considered necessary to describe their components in detail.

The machine 1 according to the invention furthermore has a supporting device 8 for supporting bags 100 which forms a unit and actuating means 18 for actuating the supporting device 8 as will be explained below. In this embodiment, the supporting device 8 is a conveyor belt. Nevertheless, solutions such as a fixed supporting surface or other solutions that make it easier for the bags 100 to transition between each of the stations of the machine are conceivable, such as, for example, a polished surface, rollers, or other mechanisms.

The supporting device 8 is arranged below the filling, welding, and cooling stations 2, 4, 6. During normal operation of the machine 1, the base of each of the bags 100 located in each of said filling, welding, and cooling stations 2, 4, 6 can thereby be supported on the supporting device 8.

Figure 4:
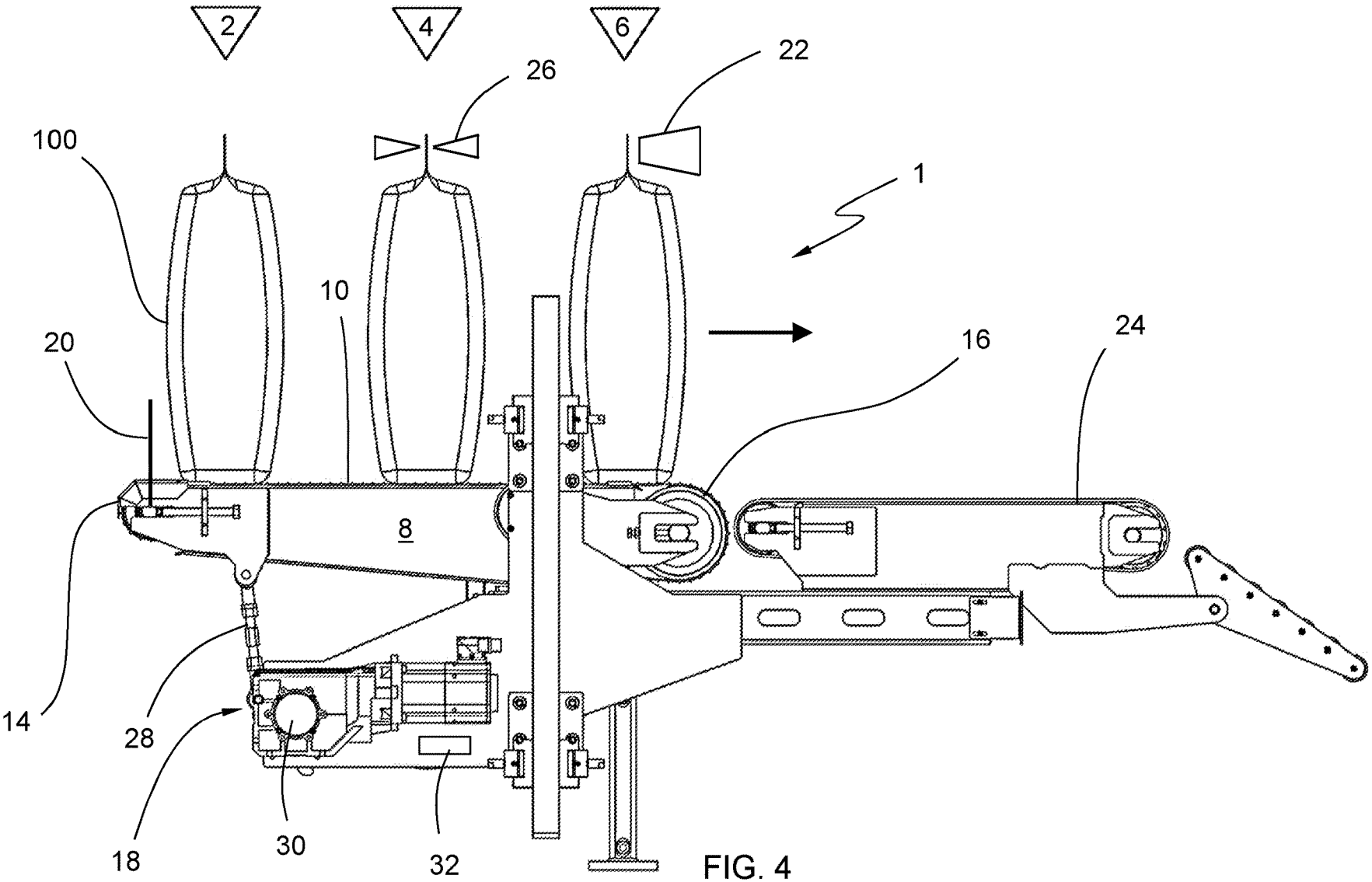
FIG. 4 shows a schematic side profile view of FIG. 2 in which the filling, welding, and cooling stations can further be seen.

The supporting device 8 comprises as its main elements a first end 14, a second end 16, a pivot shaft 12, and a supporting surface 10. The first end 14 of the supporting device 8 is arranged upstream of the filling station 2 and the second end 16 is arranged downstream of the filling station 2 according to the forward movement direction of the bags 100. Specifically, as can be seen in FIG. 1, the first end 14 is arranged upstream of the pivot shaft 12, and the second end 16 is arranged downstream of the pivot shaft 12. Furthermore, as can be seen in FIG. 4, the welding station 4 and the cooling station 6 are arranged at the same distance from the pivot shaft 12. As a result, the base of the bags 100 of the filling station 2 and welding station 4 are supported upstream of the pivot shaft 12, and the base of the bag 100 of the cooling station 6 is supported downstream of the pivot shaft 12. This causes the machine to be better balanced and for the cycle to be more quickly completed during operation.

As can be seen in FIGS. 1 to 4, the supporting surface 10 extends between the filling, welding, and cooling stations 2, 4, 6 such that each of the bags 100 is supported on the supporting surface 10. Furthermore, the supporting surface 10 is assembled in the pivot shaft 12 and forms a unit suitable for pivoting in an alternating manner around the pivot shaft 12 through the actuating means 18. This pivoting of the supporting surface 10 is possible because the supporting surface 10, the pivot shaft, and the actuating means are functionally associated with one another. Specifically, the actuating means 18 comprise a motor 30, specifically a servomotor, which is functionally connected to a crankshaft mechanism 28. This crankshaft mechanism 28 is part of the actuating means 18 and is also functionally connected to the supporting device 8. The movement generated by the motor 30 is thereby transmitted from the shaft of the motor 30 to the supporting device 8 by means of the crankshaft mechanism 28.

Likewise, the actuating means 18 comprise control means 32 which control the angular position of the motor 30. As a result, the supporting surface 10 can pivot in an alternating manner and with a variable amplitude $\alpha$ between any positions from among an upper position of said first end 14 and a lower position of said second end 16 a lower position of said first end 14 and an upper position of said second end 16, for moving the base of the bag 100 which is located in said filling station 2 in operation during filling. This pivoting movement, which is depicted with a double-headed arrow, can be seen in FIG. 3. The symbol $\alpha$ indicates the amplitude of the movement.

This pivoting movement has several synergistic effects. Firstly, it helps to compact the granular product and the filling is improved. Furthermore, by pivoting during the filling step and the granular product being compacted as it falls into the bag, the filling is also quicker. This effect also reduces the cycle time in comparison with the systems known in the state of the art. Finally, the filling is also more homogenous and, therefore, the full bag geometry is also more regular. This makes it easier to arrange the bags on pallets.

Optionally and to reduce the eventual risk of the formation of creases at the base of the bag, the supporting device 8 has a projection 20 transverse to the forward movement direction of the bags 100. This projection 20 projects from the first end 14 and is spaced apart from and upstream of the filling station 2 in the forward movement direction of the bags 100, that is, before the filling station 2. This arrangement can be clearly seen in FIG. 3.

When the machine 1 is in operation, the base of the bag 100 that is ready to be filled, in particular before beginning to fill said bag 100, is held in the projection, spaced apart from said filling station 2. This prevents the base of the bag 100 from being directly supported on the supporting surface 10 when the bag is still empty and prevents creases from being formed. Therefore, when the bag 100 begins to be filled, after a certain filling level of the bag, the weight of the granular product causes the base of the bag to exceed the projection 20. Then the bag 100 pivots and is placed on the supporting surface 10.

The method for filling bags 100 with a granular product according to the invention is explained below.

The method comprises a filling step, a welding step and a cooling step for cooling bags 100 which are consecutive and simultaneous. In other words, during the normal operating regimen of the machine 1, while one bag 100 is filled in the filling station 2, another bag 100 is closed in the welding station 4, and finally the bag 100 that first entered waits in the cooling station 6 to ensure the correct closing of the bag.

During operation, each of the bags 100 located in each of the mentioned steps is supported at the base on the supporting device 8 for supporting bags 100 which forms a unit, i.e., it is made of a single part. As previously discussed, the supporting device 8 is assembled pivoting around the pivot shaft 12.

The pivot shaft 12 is located between the welding step and the cooling step. Therefore, the filling and welding steps are carried out on one side of said pivot shaft 12, and the cooling step is carried out on the other side of the pivot shaft 12.

Through the actuating means 18 described above, the method further comprises a step of causing the supporting surface 10 to pivot. Furthermore, it also comprises another step of controlling the angular position of the motor 30 through the control means 32 for the supporting surface 10 to pivot in an alternating manner and with a variable amplitude α around the pivot shaft 12. This pivoting movement pivots between any positions from among the upper position of the first end 14 and a lower position of said second end 16 and the lower position of the first end 14 and an upper position of said second end 16. The base of the bag 100 which is located in the filling station 2 during the filling step for filling the bag 100 can thereby be moved, i.e., during the period in which the granular product is falling into the bag 100.

Figure 5:
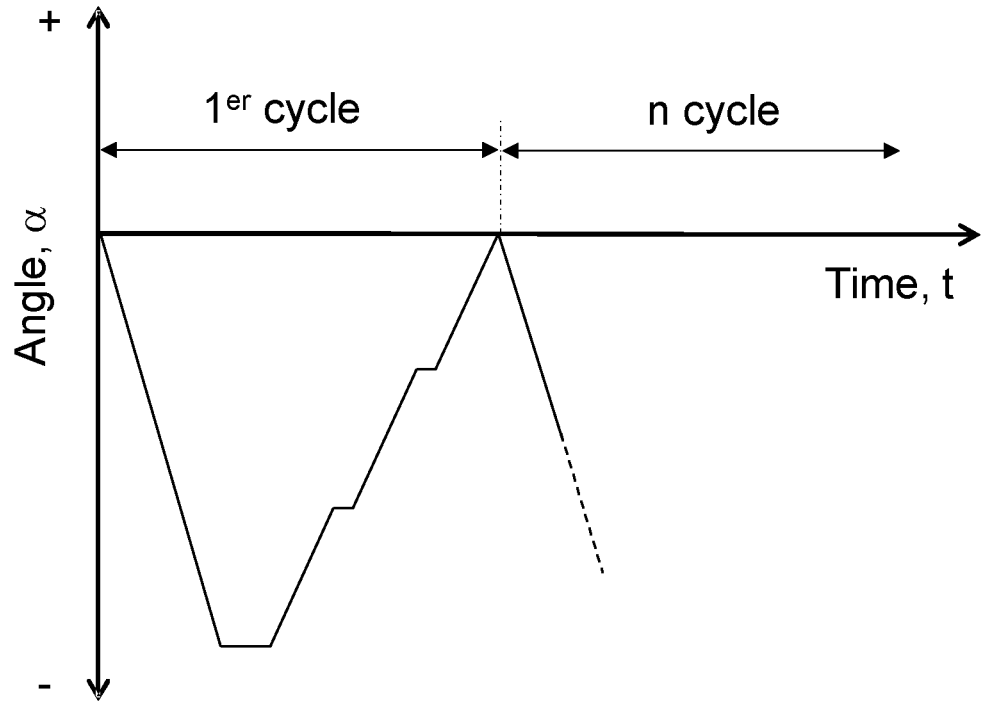
FIGS. 5 to 7 show graphs depicting the pivoting amplitude depending on the time according to different operating modes.
Figure 6:
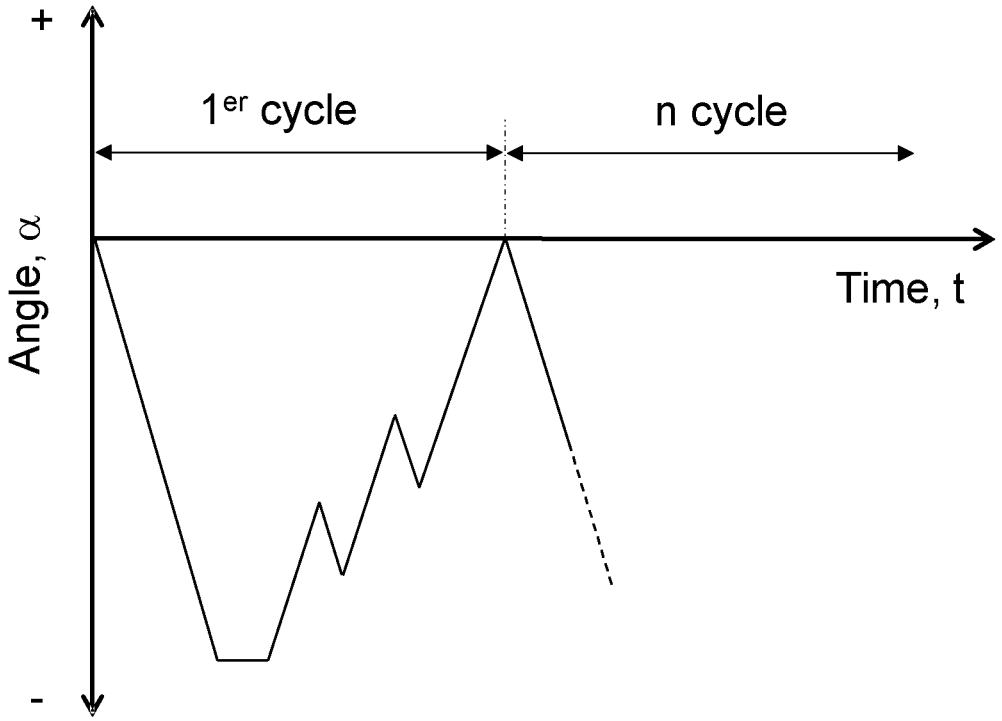
Figure 7:
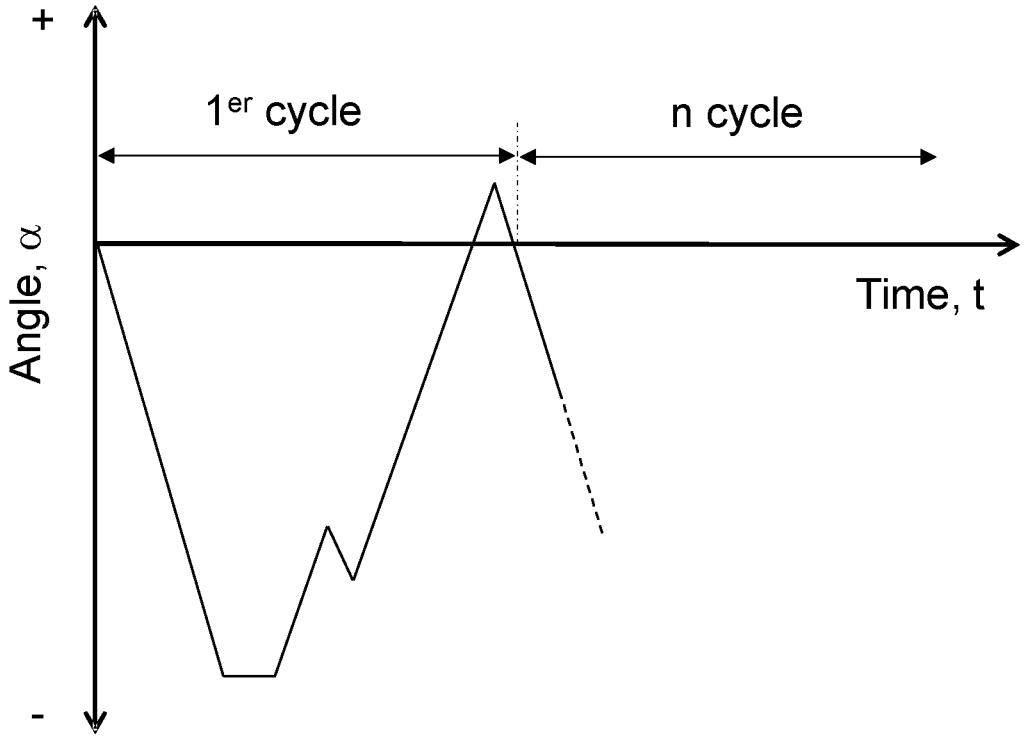

FIGS. 5 to 7 are non-limiting exemplifying graphs of several operating modes, in which the amplitude α of the pivoting movement during operation of the machine can be seen. Since the machine of the present invention has no pneumatic or eccentric actuating limitations, it is possible to configure multiple operating modes to achieve optimal filling of the bags. For example, FIG. 5 shows a non-alternating incremental movement of the supporting surface 10. This type of configuration is preferably used for filling bags with hard products that require being hit a few times. In contrast, if the bags are gradually filled with soft products which require being hit many times and a pivoting setting depending on the bag filling state, it is preferable to use a configuration mode such as the one depicted in FIG. 7.

In a preferred manner, the control means 32 are configured for the supporting surface 10 to pivot between an upper position in which the first end 14 and the second end 16 are at the same height and a lower position of the first end 14 and an upper position of the second end 16. Furthermore, this pivoting is controlled through the control means 32 for the amplitude α of the pivoting movement between said positions to decrease in a constant manner as the bag 100 is gradually filled.

The method further comprises a holding step for holding the base of the bag 100 in which, before beginning to fill the bag 100, the base of the bag 100 is held spaced apart from the filling step, upstream of the filling step, in the forward movement direction of the bags 100 to prevent unnecessary creases before beginning to fill the bag.

Moreover, once the bag 100 of the filling station is full and the bag 100 of the welding station 4 is closed and in the bag 100 of the cooling station, the weld has been sufficiently cooled, the three bags 100 are moved in the forward movement direction of the arrow shown in the figures. Therefore, the bag 100 which is located in the cooling station is discharged onto a second fixed conveyor belt 24 which discharges the closed bag 100.

The invention claimed is:

1. A machine for filling bags with a granular product, the machine comprising:

[a] a filling station,

[b] actuating means, said actuating means comprising

[i] a motor and

[ii] control means, and

[c] a supporting device for supporting bags, which forms a unit arranged below said filling station for supporting a base of a bag located in sad filling station to receive said granular product during operation, said supporting device comprising:

[i] a supporting surface,

[ii] a pivot shaft on which said supporting surface is assembled,

[iii] a first end, and

[iv] a second end, said supporting surface, said pivot shaft, and said actuating means being functionally associated with one another such that said supporting surface can pivot in an alternating manner about sad pivot shaft through said actuating means, and said control means controlling an angular position of said motor to allow sad supporting surface to pivot in the alternating manner, wherein said control means allow said supporting surface to pivot with a variable amplitude (a) into a plurality of states between and including:

[i] a first state in which said first end is in an upper position and said second end is in a lower position, and

[ii] a second state in which said first end is in a lower position and said second end is in an upper position, for moving the base of the bag which is located in said filling station during filling.

2. The machine according to claim 1, wherein said motor is a servomotor.

3. The machine according to claim 1, wherein said actuating means further comprise a crankshaft mechanism which is functionally connected to said supporting device and to said motor for transmitting movement of said motor to said supporting device.

4. The machine according to claim 1, wherein said supporting device has a projection which is transverse to a forward movement direction of said bags, which projects from sad first end, and which is spaced apart from and upstream of said filling station in the forward movement direction of sad bags, such that in operation, with said bag being ready to be filled, before beginning to fill said bag, said projection holds the base of said bag spaced apart from sad filling station.

5. The machine according to claim 1, wherein said supporting device is a conveyor belt.

6. The machine according to claim 1, further comprising a bag welding station and a bag cooling station arranged above said supporting device and downstream of said filling station in a forward movement direction of the bags, sad supporting surface extending between said filling, bag welding, and bag cooling stations such that each of said bags is supported, said supporting surface forming a unit suitable for pivoting in an alternating manner about said pivot shaft through said actuating means.

7. The machine according to claim 1, wherein said first end is arranged upstream of said filling station in a forward movement direction of said bags and said second end is arranged downstream of said filling station in the forward movement direction of said bags.

8. The machine according to claim 6, wherein said bag welding station and said bag cooling are arranged at the same distance from said pivot shaft.

9. The machine according to claim 6, wherein gas actuating means are provided in the bag cooling station arranged for insufflating cooling gas into an area corresponding to welding spots of the bag during operation.

10. A method for filling bags with a granular product, the method comprising the following steps:

[a] arranging a bag on a supporting surface of a supporting device, said bag being arranged below a filling station for filling bags to receive said granular product,

[b] filling said bag with said granular product,

[c] causing said supporting surface to pivot in an alternating manner about a pivot shaft during said filling step through actuating means comprising a motor and control means, and

[d] controlling an angular position of said motor through sad control means to pivot said supporting surface in said alternating manner, wherein said step of controlling the angular position of said motor allows said supporting surface to pivot with a variable amplitude (a) into a plurality of states between and including:

[i] a first state in which a first end of said supporting device is in an upper position and a second end of said supporting device is in a lower position, and

[ii] a second state in which said first end is in a lower position and said second end is in an upper position, for moving a base of said bag.

11. The method for filling bags according to claim 10, wherein said supporting surface pivots in said alternating manner and with said variable amplitude (a) between:

[i] a third state in which said first end and said second end are at the same height, and

[ii] said second state.

12. The method for filling bags according to claim 10, further comprising a welding step and a cooling step for welding and cooling corresponding bags, during which steps each of the bags is supported at its base on said supporting surface of said supporting device.

13. The method for filling bags according to claim 10, wherein said amplitude (a) decreases as said bag is filled.

14. The method for filling bags according to claim 13, wherein said amplitude ($\alpha$) decreases in a constant manner.

15. The method for filling bags according to claim 10, wherein said step of controlling the angular position of said motor establishes a maximum pivot position in which said first end and said second end are aligned with said pivot shaft, such that during said pivoting, said supporting surface pivots in the alternating manner between said maximum pivot position and said second state.

16. The method according to claim 10, wherein said supporting device has a projection transverse to a forward movement direction of the bags, said projection projecting from said first end and being spaced apart from and upstream of said filling station in the forward movement direction of the bags, the method further comprising a holding step for holding the base of said bag at said projection, wherein in the holding step, before beginning to fill said bag, the base of said bag is held at said projection spaced apart from said filling station.

* * * * *